US005305009A

United States Patent [19]

Goutzoulis et al.

[11] Patent Number: 5,305,009

[45] Date of Patent: Apr. 19, 1994

[54] HYBRID ELECTRONIC-FIBEROPTIC SYSTEM FOR PHASED ARRAY ANTENNAS

[75] Inventors: Anastasios P. Goutzoulis, Pittsburgh; David K. Davies, Churchill Borough; Casey J. Coppock, Greensburg; John M. Zomp, North Huntingdon, all of Pa.

[73] Assignee: Westinghouse Electric Corp., Pittsburgh, Pa.

[21] Appl. No.: 988,609

[22] Filed: Dec. 10, 1992

[51] Int. Cl.[5] ..... H01Q 3/38

[52] U.S. Cl. ..... 342/157; 342/372

[58] Field of Search ..... 342/157, 371, 372

[56] References Cited

U.S. PATENT DOCUMENTS

| | | | |
|---|---|---|---|
| 4,028,702 | 6/1977 | Levine . | |
| 4,814,773 | 3/1989 | Wechsberg et al. | 342/371 X |
| 5,164,735 | 11/1992 | Reich et al. | 342/372 X |
| 5,257,030 | 10/1993 | Aoki et al. | 342/372 X |

OTHER PUBLICATIONS

Westinghouse Proposal dated Apr. 1991 entitled "Hardware-Compressive True-Time Steering Optical System for Control of Phased Array Antennas", pages cover sheet, 1-1, 1-2, 4-1 thru 4-11, 5-1, 5-2, 6-1 thru 6-5.

A. Goutzoulis, D. Davies, "Hardware Compressive 2-D Fiber Optic Delay Line Architecture for Time Steering of Phased Array Antennas," *Applied Optics* vol. 29, No. 36, pp. 5353-5359, 1990.

*Primary Examiner*—T. H. Tubbesing
*Attorney, Agent, or Firm*—Eugene LeDonne

[57] ABSTRACT

An improved phased array radar system has a plurality of bias binary fiber optic delay lines each connected between the transmit/receive cells and at least one of signal input means and signal processing means. A plurality of electronic binary delay lines are connected to at least one of the signal input means and the signal processing means and each bias binary fiber optic delay line.

6 Claims, 4 Drawing Sheets

HYBRID ELECTRONIC-FIBEROPTIC SYSTEM FOR PHASED ARRAY ANTENNAS

BACKGROUND OF THE INVENTION

1. Field of Invention

This invention relates to phased array antennas which have delay lines between the transmit/receive cells and the input for the radar signal to be transmitted.

2. Description of the Prior Art

Phased array antennas are comprised of a plurality of transmit/receive cells typically arranged on a series of parallel rows in an array. When the antenna is in a transmit mode the radar signal must be distributed over the cells. Usually all cells do not receive the signal at the same time. The art has developed binary fiber optic delay lines, known as BIFODELs, which carry radar signals to and from the transmit/receive cells. These BIFODELs have been designed and selected so that the time delays between signal arrivals at selected cells are known. Typically, one BIFODEL will serve a group or set of transmit/receive cells called a transmit/receive module.

Future high-performance phased array antennas will be required to have large scan angles, wide instantaneous bandwidths (100s of MHz), center frequencies anywhere from the UHF to the X bands, and multiple beam capability. The actual number of transmit/receive modules depends on the system mission as well as its operating frequency, and typically is in the $10^2$–$10^4$ range for all airborne, ground, and shipboard radars. Similar requirements exist for multi-function, front-end systems, which are expected to have even larger bandwidths because of the integration of radar, ECM and COM.

To satisfy the wide bandwidth requirements of such phased array antennas true time delay frequency-independent steering techniques must be used. Optical fiber is an excellent medium for both the delay generation and signal distribution because: (i) it can store large bandwidth analog signals (~100 GHz) for long hours (10s of μs), (ii) it has low attenuation (<0.1 db/km) which is flat over radio frequencies up to 100 GHz, (iii) it allows the remote processing of phased array antenna signals, (iv) it has excellent transmission stability by virtue of the small ratio of signal bandwidth to optical carrier frequency, (v) it allows optical wavelength multiplexing (λ-MUX) to minimize the number of lines in the phased array antenna feed link, (iv) it is a non-conducting dielectric and so does not disturb the RF field, is secure, and EMI immune, and (vii) it is flexible, it has low mass, and small volume.

It can be shown that the straightforward implementation of true time delay for large phased array antennas results in very large amounts of hardware that reduces the overall practicality of the true time delay concept. Specifically, the hardware complexity is proportional to the product of the number of antenna elements (K) and the number of different steering angles (R). In practice K and R are in the $10^2$ to $10^4$ and $10^2$ to $10^3$ ranges, respectively. Thus, innovative techniques are required for compressing the hardware complexity with respect to both K and R.

The most efficient hardware compression with respect to R is accomplished via the use of binary fiberoptic delay lines. In a BIFODEL the optical signal is optionally routed through N fiber segments whose lengths increase successively by a power of 2. The various segments are addressed using a set of N 2×2 optical switches. Since each switch allows the signal to either connect or bypass a fiber segment, a delay T may be inserted which can take any value, in increments of ΔT, up to the maximum value, $T_{max}$, given by:

$$T_{max}=(2^0+2^1+\ldots 2^{n-1})\,\Delta T=(2^N-1)\,\Delta T \quad (1)$$

Note that the BIFODEL may be implemented with a combination of fiber and/or free space delays, and offers $\log_2$ level compressive fiber/switch complexities ($M_{f/s}$):

$$M_{f/s}=\log_2 R. \quad (2)$$

Unfortunately, the BIFODEL concept alone does not solve the overall hardware complexity problem since a K-element phased array antenna requires K different BIFODELs.

THE PARTITIONED FIBER OPTIC SYSTEM

In a 1-D phased array antenna, compression with respect to K can be accomplished via partitioning in conjunction with λ-MUX. In a K-element partitioned phased array antenna there exists E sets of N elements each, such that K=N×E. In this case the delay required by the i-th element of the j-th set is equal to the delay of the i-th element of the first (or reference RS) set plus a bias delay. This bias delay depends only on j and not on i, and thus it is common to all the elements of a given set. This results in very significant reduction in hardware complexity in terms of both BIFODEL type and BIFODEL quantity. Specifically, the total number of different types of BIFODELs is N+E (i.e., N for the RS plus E for the bias delays) sinc only one bias BIFODEL is required per RS set and it is possible to cascade each of the N BIFODELs of the RS to all E bias BIFODELs and thereby address all N×E elements of the phased array antenna. In this case, the overall hardware complexity, $M_c$, (with $$N = E = \sqrt{K})$$

is given by $$M_c = (\log_2 R) \times (2\sqrt{K} - 2),$$

which is to be compared with M=R×K for the straightforward non-compressed implementation.

FIG. 1 illustrates the partitioned phased array antenna concept using a N-channel optical wavelength multiplexer. This hardware can be used for both the transmit and receive modes. Input means 10 provide a microwave signal to be transmitted. In the transmit mode (N−1) RS BIFODELs 11 with outputs at wavelengths $\lambda_2, \ldots, \lambda_N$, are driven in parallel by the radar signals. The (N−1) BIFODEL outputs together with the non-delayed signal at wavelength $\lambda_1$ are multiplexed via a N-channel MUX 12, the output of which is divided into E channels via an E-channel optical splitter 14. All but one of the splitter outputs independently drive a bias BIFODEL 16, each of which is followed by an N-channel optical demultiplexer (DMUX) 18. The undelayed splitter output channel is also demultiplexed. Since the optical inputs to each bias BIFODEL contain N wavelengths, the DMUX output will also contain N wavelengths $\lambda_1, \lambda_2, \ldots \lambda_N$. The outputs of the non-biased DMUX contain the N progressively delayed signals required for the RS (set 1 in FIG. 1) which requires no bias delay. The outputs of each of the remaining DMUXs contain a similar set of signals (but which are further delayed via the bias BIFODELs), and correspond to a different phased array set. Similar wavelength outputs drive similar location elements in each set.

In the receive mode, the same architecture is used but in reverse. Here the output of each phased array antenna element drives a laser of a different wavelength. Elements with similar locations in different sets drive laser diodes of the same wavelength. For each phased array antenna set, the laser diode outputs are multiplexed and drive a bias BIFODEL. Note that at the outputs of the bias BIFODELs, the set-to-set bias delays have been eliminated. Next, the outputs of the bias BIFODELs are combined via an E-channel optical combiner, the output of which is subsequently demultiplexed. Each of the DEMUX outputs drives a RS BIFODEL, which eliminates the in-set delays. The last step is to add the outputs of the reference BIFODELs via a combiner, the output of which provides the desired vector sum. Note that this combination can take place in the RF or optical domains.

Although the partitioned fiber optic system is useful for some applications it is relatively expensive. Furthermore, the hardware is quite complex for large arrays. There is a need for a reliable, less expensive, less complex phased array. Electronic components are reliable and less expensive than optical components. However, low-cost microwave electronic techniques cannot perform all functions in a phased array radar system.

SUMMARY OF THE INVENTION

We provide a hybrid electronic fiberoptic system for phased array antennas. Rather than use initial reference BIFODEL elements to receive the input microwave radar signal to be transmitted, we provide electronic binary delay lines and laser diodes. The electronic binary delay lines preferably use back-to-back $1\times2$ switches to implement a $2\times2$ switch. The difference between two switched paths gives the desired delay. This allows great flexibility in setting and tuning the actual delays as we will see in more detail later. Furthermore, the electronic binary delay line is fully reversible, i.e., the signal can propagate from either end. This is very important in that it allows the same line to be used for both the transmit and receive mode. The advantages of electronic binary delay lines over BIFODELs for implementing the RS portion of the system include: (1) much lower cost, (2) the potential for certain phased array antenna scenarios to implement the RS delays in integrated circuit form using GaAS MMIC and/or wafer-scale integration techniques; and (3) much smaller size. Electronic binary delay lines are inherently two dimensional devices, whereas fiberoptic BIFODELs are three-dimensional. The cost of a hydrid delay line is approximately two orders of magnitude less per delay line because electronic switches cost significantly less.

Our system utilizes BIFODELs for the bias delays. Use of electronic binary delay lines for the RS delays and BIFODELs for the bias delays results in a hybrid true time delay λ-MUX architecture. Such a hybrid architecture has advantages over an all-optical approach. It uses fiber optics only where standard low-cost microwave electronic techniques cannot perform, and it preserves the unique features of optics. A λ-MUX is used for implementing the hardware compression architecture. Optical fiber is used for the implementing long delays. However, it is not necessary to implement all the bits of the RS delay lines in the electronic domain; we can implement as many bits as possible in the electronic domain and then revert to fiberoptic delays prior to λ-MUX. This allows the hybrid scheme to be used for very large phased array antennas for which the sole use of electronic binary delay lines in the RS level may not be possible. Finally, since both the electronic binary delay lines and BIFODELs are reversible, the hybrid architecture is also reversible.

Other objects and advantages of the present invention will become apparent from a description of certain present preferred embodiments shown in the drawings.

DESCRIPTION OF THE PREFERRED EMBODIMENTS

The all-optical architecture we have described is well suited for various phased array antenna applications for both 1-D and 2-D antenna formats. However, it can be optimized considerably depending on the actual application. Since phased array antennas are particularly useful in surveillance scenarios (which typically reside in the L and/or S frequency bands) we consider 2 such scenarios: (1) a 10.6 m long L-band (f=1.4 GHz) 1-D phased array antenna with K=100 elements, and (2) a 12.7 m long S-band (f=3.0 GHz) 1-D phased array antenna with K=256 elements. Assuming that the phased array antennas are partitioned with $$N = E = \sqrt{K}$$

we find that the maximum RS delays occur for element #10 and #16, respectively, for the two different scenarios. For a maximum scan angle of ±45° in conjunction with a 6-bit BIFODEL, one can easily show that the delays for each of the BIFODEL bits are - example #1:73, 147, 293, 586, 1173 and 2346 ps, and example #2: 57, 114, 228, 456, 912 and 1824 ps.

For both the L and S band phased array antenna examples, the RS delays are small enough to be well within the transmission capabilities of microstrips (or striplines) without serious different attenuation and/or delay (or phase) dispersion effects as a function of frequency. For example, using ARLON Isoclad-917 31-mil board with a dielectric constant $\epsilon=2.17$, delay lines with over 2 ns delay can be fabricated which have a differential attenuation of ~0.7 dB and ±(2-4) ps delay dispersion over the 0.5–4 GHz band. Furthermore, one can use simple coaxial ultra-low loss cable (e.g., GORE, 0.12" cable) for ~3 ns delay lines with better than 0.5 dB differential attenuation and ±1 ps dispersion over the 0.5–4 GHz band. In addition, low cost 1×2 GaAs FET switches are available that operate well over the S-band with very low insertion loss (<0.5 dB) and a response which is flat (to better than ±0.05 dB) over the 0.5–3.5 GHz band. From these data, we conclude that for many typical L-and S-band phased array antenna applications, the reference BIFODELs can be implemented using electronic binary delay lines. This is not necessarily the case for all phased array antenna scenarios because, for the large phased array antennas at higher frequencies, (e.g. X band) the board and/or cable attenuation and/or dispersion is unacceptable.

Figure 1:
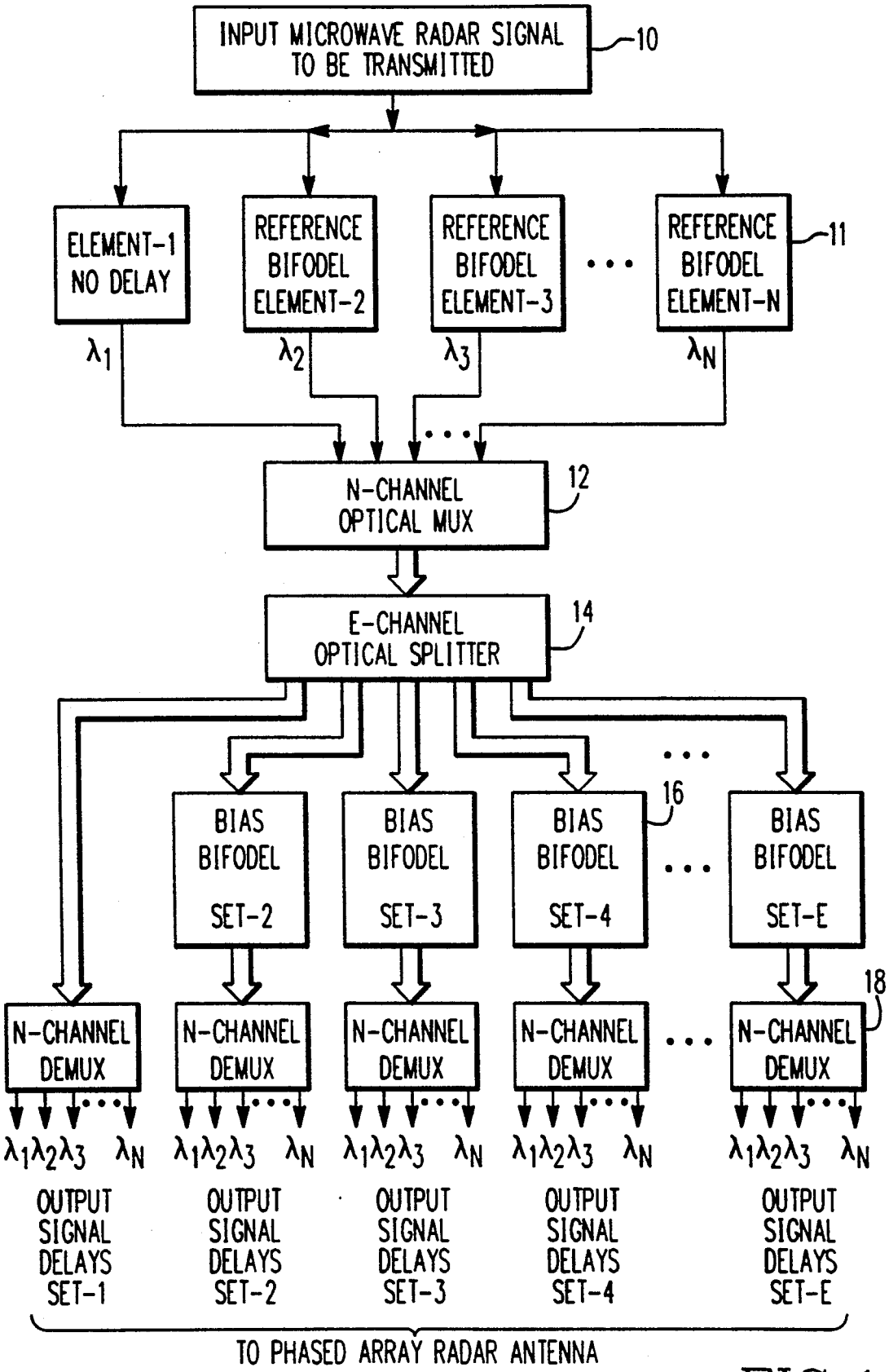
FIG. 1 PRIOR ART
FIG. 1 is a block diagram of a prior art phased array radar system which utilizes all optical delay lines.
Figure 2:
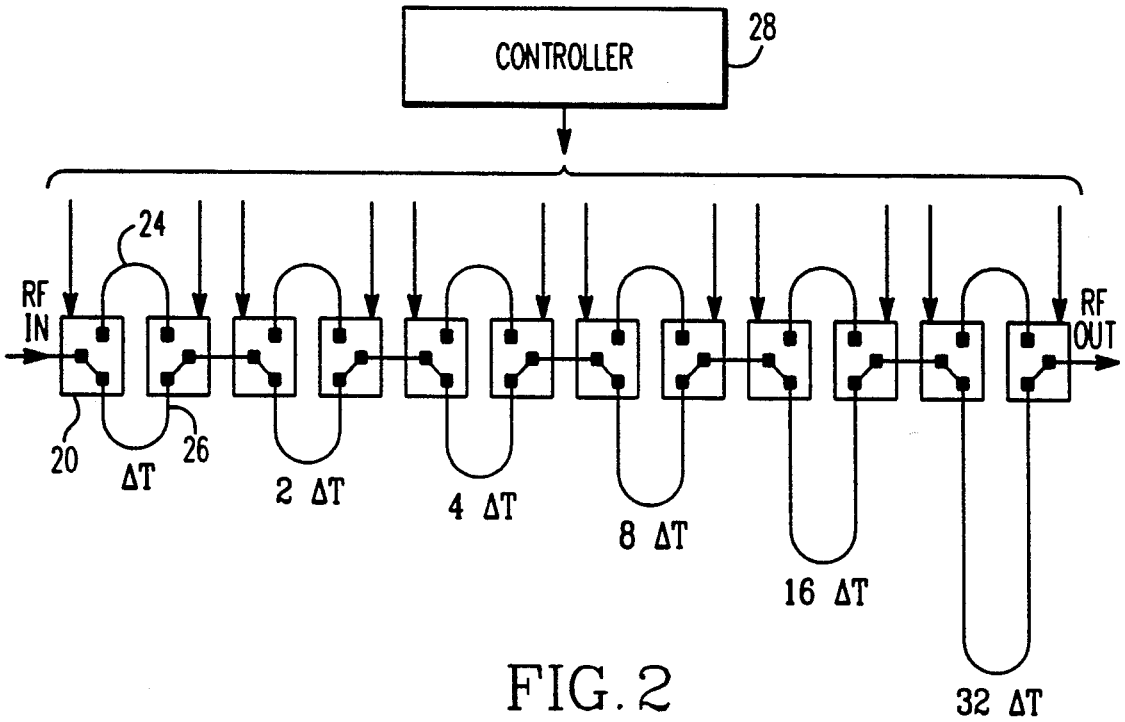
FIG. 2 is a block diagram of a 6-bit electronic binary delay line.

FIG. 2 shows a block diagram of a 6-bit electronic binary delay line architecture which uses two back-to-back switches 20 to implement a 2×2 switch. The switches are preferably GaAS FET switches. They permit a signal to flow in either direction through a series of lines of equal length 24 or a set of lines of progressively greater length 26. We prefer to size lines 26 so that the time delay ΔT doubles as the signal travels across consecutive switches. This allows great flexibility in setting and timing the actual delays. The switches are controlled by a controller 28 which preferably is a personal computer programmed to activate the switches to provide a desired time delay.

Figure 3:
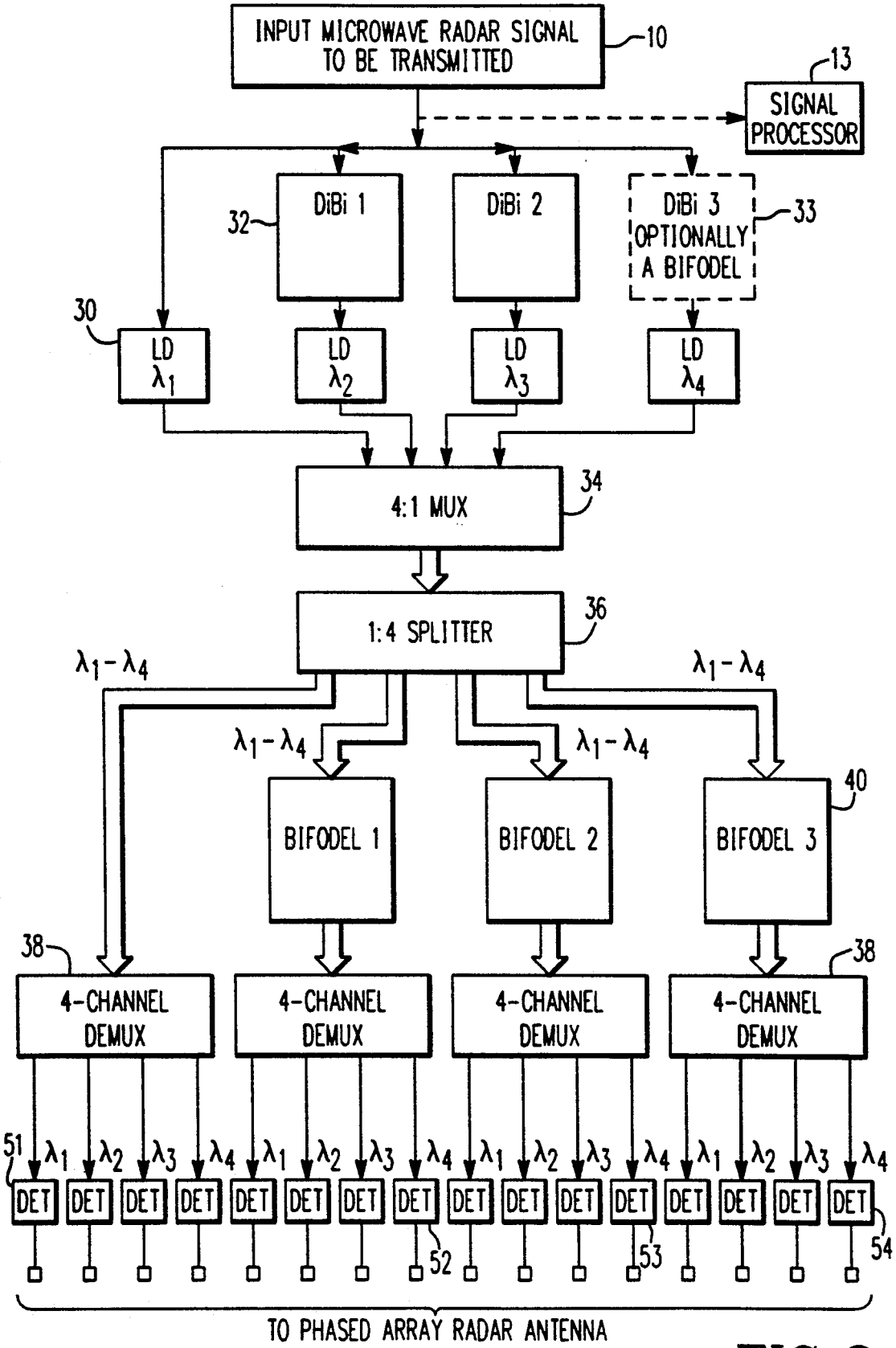
FIG. 3 is a block diagram of a 16-element hybrid wavelength multiplexed true time delay phased array radar system of the present invention.

The present preferred embodiment of our hybrid system shown in FIG. 3 has input means 10 which provides the radar signal to be transmitted to laser diode $LD\lambda_1$ and electronic binary delay lines 32 labeled DiBi 1, DiBi 2 and DiBi 3. The delayed signal from DiBi 1, DiBi 2 and DiBi 3 go to laser diodes labeled $LD\lambda_2$, $LD\lambda_3$ and $LD\lambda_4$. The laser diodes 30 input into multiplexer 34 connected to splitter 36. One splitter output signal flows directly to a four channel demultiplexer 38 and on to the first module of transmit/receive cells 51. The remaining three splitter outputs go to bias BIFODELs 40 and then through demultiplexers 38 to other cell modules 52, 53, 54. For some applications one may choose to use a BIFODEL indicated by dotted line box 33 to provide delay rather than an electronic binary delay line. Such a system may use both BIFODELs and electronic binary delay lines in the reference portion of the unit. The system of FIG. 3 is reversible and could be used as a receiver. In that event a signal processor 13 shown in chainline would be used.

In designing the DiBi, much attention must be paid to the material used for transmission line which preferably is a microstrip. Ideally the microstrip must have the following characteristics: (1) low differential attenuation over the band of interest so that the overall passband is as flat as possible; (2) low dielectric dielectric constant ε so that the delay accuracy is as high as possible; and (3) low phase dispersion as a function of length and frequency. Requirement 2 is dictated by the fact that the speed of propagation ($U_p$) in the microstrip material is given by $$U_p = C/\sqrt{\epsilon_{ef}}\,, \tag{4}$$

where $\epsilon_{ef}$ is the effective dielectric constant given by $$\epsilon_{ef}=0.5\,(\epsilon+1)+0.5\,(\epsilon-1)[1+12\,h/W]^{-0.5}, \tag{5}$$

and h is the thickness of the dielectric surface, W is the width of the microstrip, and where $W/h \geqq 1$. Thus, it is obvious that the "faster" the material, the longer the distance per unit of time, and thus the better the accuracy in determining the exact length of the segments. Requirement 3 simply expresses the need for the true time delay to be independent of frequency. Note that at low frequencies (i.e. a few GHz) the effective dielectric constant is for all practical purposes independent of frequency. However, as the frequency increases both $\epsilon_{ef}$ as well as the characteristic impendance ($Z_o$) of the microstrip line begin to change (due to the propagation of hybrid modes) making the transmission line dispersive. The frequency dependence of $\epsilon_{ef}$ describes the influence of dispersion on the phase velocity, whereas the frequency dependence of the effective width describes the influence of the dispersion on $Z_o$. Note that frequency dispersion can be a series factor limiting the extension of the hybrid system to frequency bands significantly higher than S. Fortunately, for frequencies in the L- and S-bands, with good board fabrication, the changes in $\epsilon_{ef}$ and $Z_o$ with frequency are very small. The frequency below which dispersion effects may be neglected is given by the relation $$f_o\,(GHz) = 0.3\sqrt{[Z_o/h\sqrt{\epsilon-1}]} \tag{6}$$

where h is given in cm.

With the above in mind, we have acquired and tested various board materials in order to identify the material that best satisfies the above requirements. For all acquired board materials, we designated (using CAD software) and fabricated various delay segments which we then evaluated on a network analyzer. Although our search was by no means exhaustive, it did show that ARLON Isoclad-917 board provides excellent results, and for $Z_o = 50\ \Omega$, the attenuation is less than 0.5 dB for a 1.2 ns delay, and the worst case peak-to-peak delay dispersion is less than ±3 ps.

The next step is to identify a suitable, low cost switch which will allow us to implement a miniaturized, low cost DiBi. The switch requirements are: (1) flat frequency response over the desired band, (2) low insertion loss, (3) low crosstalk, and (4) low phase dispersion. Once again we have performed a market search which identified several low-cost ($25–40) 1×2 FET switches that satisfied our requirements. Typical data obtained are: (1) ±0.5 db frequency response from DC - 3 GHz with low ripple (<0.05 dB), (2) isolation of better than 40 dB over the 0.7–1.4 GHz band, (in practice, this translates to better than 80 dB because we use two 1×2 switches per segment), (3) insertion loss of <0.5 dB per 1×2 switch (or <1 dB per 2×2 switch), (4) 1 dB compression point of +23 to +30 dBm, (5) peak-to-peak phase dispersion of ±1° over the 0.7–1.4 GHz band, (6) reconfiguration speed of <6 ns, and (7) typical dimensions of 5×5×1 $mm^3$. Using such switches we have designed, fabricated, and tested the 3 DiBis, the performance of which is described in detail later.

Our prototype transmit-only system requires 4 different wavelengths which can be best optimized in the 1270–1340 nm band where narrow spectral width (full-width half-maximum, FWHM, <0.1 nm), wide bandwidth (<5 GHZ), low noise (<−155 dB/Hz) DFB laser diodes are commercially available from several manufacturers. These narrow spectral widths enable the practical laser diode to laser diode wavelength spacing to be as close as 1 nm, since MUX/DMUX devices having compatible resolution are also commercially available. These types of DFB laser diodes have typical output power levels of 2-8 mW, differential efficiencies of 0.1-0.2 mW/mA and are packaged with integral optical isolators, coolers, feedback detectors, etc. The wavelength stability of these laser diodes as a function of temperature is typically 0.2 nm/° C., and since temperature regulation of better than 0.2° C. is easily achievable, wavelength stability of better than 0.04 nm is easily maintained.

For the transmit system, no serious wavelength spacing problems exist and in principle a 1 nm laser diode wavelength spacing can support the transmit system of a 70×70 (i.e 4900) element phased array antenna. However, far more stringent constraints exist for the receive system and, since in any practical system the transmit and receive systems must be identical, we have to discuss these additional constraints.

We recall that for the receive system, phased array antenna elements of similar location within different sets must have the same wavelength so that they can all be compensated simultaneously by the same reference delay line. Since output of the delay line leads to a single detector, care must be taken so that small differences among the "same" wavelengths do not result in in-band beat notes, produced by the mixing of the various wavelengths, at the square-law detector. Given that locking of the various similar wavelengths to within a few Hz is virtually impossible (especially for more than 2 LDs), we must make sure that any beat notes fall well outside the RF band of the system. One can show that for the simple case of 2 unmodulated LDs at optical frequencies $f_1$ and $f_2$, the beat power spectral density $S_b(f)$ is given by $$S_b(f)=0.25\,E_1^2E_2^2[\delta(f+f_1-f_2)+\delta(f-f_1+f_2)] \quad (7)$$

where $E_1$ and $E_2$ are the amplitudes of the two laser diode optical fields. The term of interest is the first term within the bracket of Equation (7) and corresponds to the difference beat note between $f_1$ and $f_2$. Thus, we conclude that the separation between "similar" wavelength laser diodes must be at least equal to the RF bandwidth of the phased array antenna system, otherwise the beat notes will fall within the band. In practice, the separation must be kept even wider (e.g. 2x-3x that of the RF bandwidth) in order to avoid beat note movement within the band because of temperature changes, laser diode aging, or other factors.

From the above discussion, we can now calculate the separation requirements for a 4×4 receive system. For this case, we can place the 16 laser diodes over the 1270-1340 nm band with maximum laser diode to laser diode separation $\Delta\lambda=4.66$ nm, which corresponds to a difference beat note spacing of 864 GHz and obviously does not present any real problem. Results of this type of analysis for higher order systems are shown in Table 1.

TABLE 1

Laser diode wavelength separation for various phased array antenna element populations

| Phased Array Antenna Elements | Laser Diodes Required | Max Laser Diode Separation (nm) | Beat Frequency (GHz) |
|---|---|---|---|
| 16 (4 × 4) | 16 | 4.66 | 864 |
| 64 (8 × 8) | 64 | 1.11 | 206 |
| 256 (16 × 16) | 256 | 0.27 | 51 |
| 1024 (32 × 32) | 1024 | 0.07 | 13 |

From Table 1 we see that for systems up to 8×8, the beat notes represent no problem even if the full 2-18 GHz RF band is to be implemented with the same true time delay network. For higher order systems, there is a constraint in the overall usable RF bandwidth of the true time network. For example, for the 32×32 case and assuming a separation of 3×bandwidth, the resulting RF bandwidth is no more than 4.3 GHz. In addition, as the separation of laser diodes is reduced, the full width of the laser diodes at power levels much lower than −3 dB (e.g. −40 dB optical) becomes important because any given laser diode power at this level beats with that of the neighboring laser diodes (at a similar low power level) and the difference will appear within the RF bandwidth. However, these spurious signals will be at much lower power levels compared with the level of the signal of interest, e.g., −40 dB optical sidebands produce noise beats at a level of −80 dB in the RF domain, a level which is acceptably low for many phased array antenna applications. At the −40 dB level, the full width of currently available DFB laser diodes is less than 0.5 nm so that systems up to 12×12 are easily accommodated. However, higher order systems having a high dynamic range become more difficult to implement even if the laser diode separation requirement can be satisfied.

Finally, since we are dealing with a system which must provide high-accuracy non-dispersive delays, we must examine the role of fiber dispersion in producing differential delays. This is because the inputs to the bias BIFODELs consist of all the different wavelengths, and the fiber itself introduces small but nevertheless different delays at the various wavelengths. State-of-the-art single mode fibers, such as Corning SMF-28 CPC 3 fiber and Philips DFSM fiber, over the 1270-1340 nm band exhibit typical dispersion in the range 4-6 ps/nm-km. Using an average figure of 5 ps/nm-km for a 70 nm band, we find that the worst-case dispersion is 0.35 ps/m. In our prototype the total length of the longest bias BIFODEL is ~0.6 m (i.e., ~3ns) for which the worst case dispersion is about 0.2 ps, and is negligibly small. However, if necessary, these delays can be reduced significantly by using the all-optical architecture in a reverse way, that is propagate via the bias BIFODELs first and then via the reference BIFODELs. In this way, the multi-wavelength signals will be present only at the reference BIFODELs which use much smaller fiber lengths thereby minimizing the delay dispersion.

BIFODEL Design

There are two major factors that must be considered in the BIFODEL design: (1) the overall BIFODEL architecture, and (2) the optical switches used. Since several possible BIFODEL architectures exist, we have developed criteria on which to choose the optimum architecture. We have examined in detail th various criteria and have concluded that the most critical ones are (1) the overall optical loss (A), (2) the stability of the optical loss, and (3) the hardware complexity (C).

Figure 4:
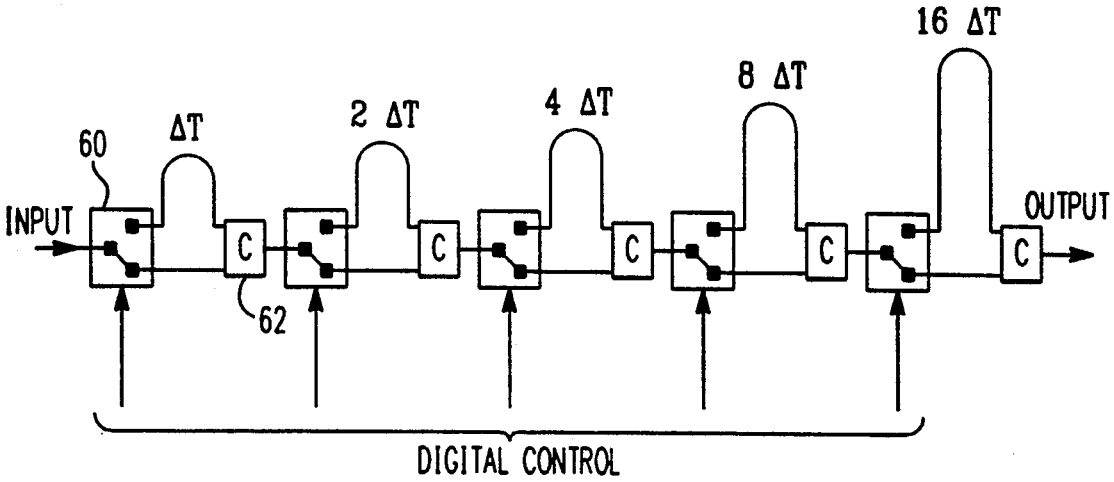
FIG. 4 is a block diagram for a BIFODEL which can be used in our system.
Figure 5:
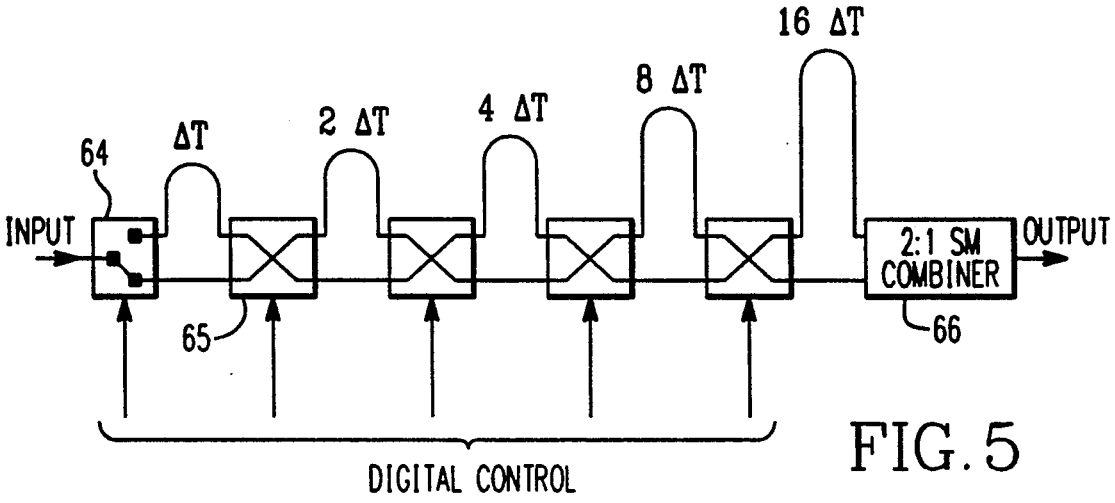
FIG. 5 is a block diagram of a second BIFODEL which can be used in our system.
Figure 6:
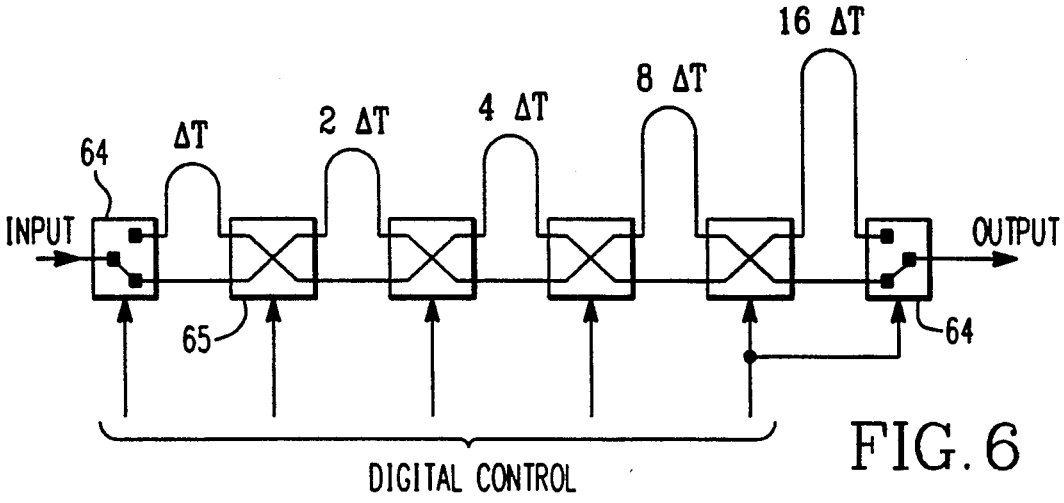
FIG. 6 is a block diagram of a third BIFODEL which can be used in our system.
Figure 7:
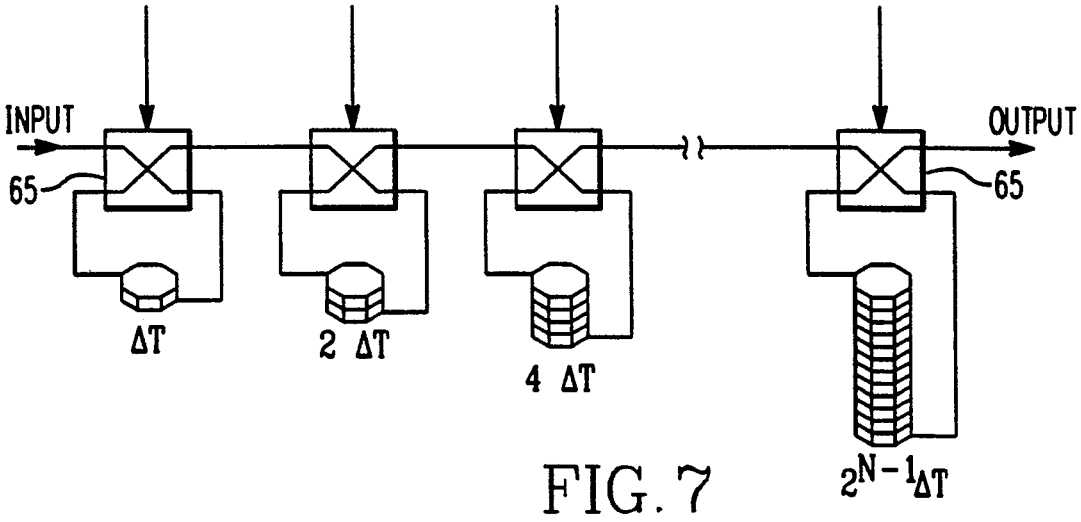
FIG. 7 is a block diagram of a fourth BIFODEL which can be used in our system.

There are at least 4 different BIFODEL architectures whose hardware complexity and loss are different. FIGS. 4, 5 and 6 show the first 3 designs for N=5 and FIG. 7 shows the fourth design. Design 1 of FIG. 4 uses N 1×2 switches 60 and N 2:1 fiberoptic combiners 62. It has a loss figure $A(dB)=N(S_1+3)$ where $S_1$ is the insertion loss of the switch (in dB) and 3 DB is the minimum possible loss encountered in a standard 2:1 single mode fiberoptic combiner. Assuming that all switches have the same $S_1$ figure and that no significant attenuation changes occur as different length fiber segments are switched on, the loss is independent of the BIFODEL switch program, i.e., the loss is stable. Design 2 (FIG. 5) uses N−1 2×2 switches 65, one 1×2 switch 64, and one 2:1 fiberoptic combiner 66. The loss figure is $A(dB)=NS_1+3$ and for the same assumptions does not vary with the switch program. For this design, the complexity is N switches+1 combiner. Design 3 (FIG. 6) requires N−1 2×2 switches 65 and 2 1×2 switches 64. It has a stable loss figure of $A(dB)=(N+1)S_1$ and a hardware complexity of N+1 switches. Finally, design 4 (FIG. 7) requires the lowest component complexity of N 2×2 switches 65. However, it has a non-stable loss figure that varies between $NS_1$ and $2NS_1$ as the BIFODEL program changes. This is because, depending on the program, the signal might enter the same switch twice thereby showing a loss figure $A(dB)=NS_1$ to $2NS_1$.

TABLE 2

6-bit comparison of the 4 BIFODEL designs for $S_1$ = 1 dB.

| | A (dB) | Stability (dB) | Complexity |
|---|---|---|---|
| DESIGN 1 | 24 | 0 | 12 |
| DESIGN 2 | 9 | 0 | 7 |
| DESIGN 3 | 7 | 0 | 7 |
| DESIGN 4 | 6-12 | ±3 | 6 |

Table 2 shows a comparison of the performance of the four designs for N=6 and $S_1=1$ dB. From Table 2 we see that the best design is #3 because it has the minimum loss, is stable and has a very low complexity. The less complex design (#4) can be very lossy, and most importantly its loss is not stable which means that significant correction must be made (up to 12 dB in the RF domain). Based on these data, we have selected design 3 for implementing the BIFODELs.

There are several key specifications which the switches must satisfy that are determined mainly by system requirements and include: (1) 2×2 configuration, (2) low insertion loss (e.g. 1db or better), (3) >50 dB optical crosstalk, (4) switching speed of 10s of μs or better (although several applications exist where ms response is acceptable, (5) small size and low power consumption, and (6) low cost. In addition, it is desirable to have switches with several parallel 2×2 configurations so that with one switch we can implement all the BIFODELs in parallel. Parallel switching is possible because, at any given time, the same binary program is needed for all BIFODELs (and DiBis). Several technologically different types of switch exist that could conceivably be used for the BIFODELs. In general, the performance of these switches varies significantly and most of them are not yet developed to the point that they can be used in current systems. For example, 2×2 ferroelectric liquid crystal switches (FLC) have been demonstrated with rise times of 150 μs (i.e. switching times of ~400 μs). However, their insertion loss is currently −3 dB and their crosstalk about −27 dB. Furthermore, various types of 2×2 integrated optical switches are commercially available from several vendors with typical switching speeds of ~1ns. However, their insertion loss is high (3-6 dB) and their crosstalk (−20 to −30 dB) is unacceptable. We prefer to use commercially available piezomechanical switches which have been optimized for BIFODEL use and which have the following performance characteristics: insertion loss of less than 1 dB, optical crosstalk of less than 60 dB, and optical rise time of less than 1 ms. These switches are satisfactory for our purposes and, furthermore, they are sufficiently fast for most UHF and many L-band phased array antennas.

The overall system control is extremely simple since all DIBis and BIFODELs require the identical binary program. This is because for the same bit in both the DiBis and the BIFODELs, the respective delay segments correspond to exactly the same angle. Thus, to address the full system we generate a 6-bit digital control word which is applied in parallel to all delay lines. This 6-bit word is the binary representation of the desired look-angle and is independent of the number or location of the phase array antenna elements.

The philosophy behind the proposed technique is to use electronics as much as possible and revert to optics only where electronics fails. By using binary delay lines and the unique property of optics to perform non-interactive wavelength multiplexed interconnections, the proposed architecture achieves the smallest hardware complexity of any known true time delay technique. Specifically, the overall system hardware complexity is $$(\log_2 R)(2\sqrt{K}-2)$$

where R is the number of steering angles and K is the number of phase array antenna elements. We have analyzed all the main features of the proposed system and have shown that by using commercially available components, true time delay steering for antennas with up to 12×12 elements (or subarrays) can be fabricated before the need to replicate hardware.

Although we have shown and described certain present preferred embodiments of our invention, it should be distinctly understood that the invention is not limited thereto but may be variously embodied within the scope of the following claims.

We claim:

1. An improved phased array radar system of the type comprised of a plurality of transmit/receive cells partitioned into N cell sets, and at least one of input means for inputting to the transmit/receive cells a radar signal to be transmitted and processing means for processing radar signals received from the transmit/receive cells wherein the improvement comprises:

a) a plurality of demultiplexers, one demultiplexer connected to each cell set;

b) N−1 binary fiber optic delay lines each connected to a different cell set;

c) a splitter connected to the binary fiber optic delay lines and one demultiplexer;

d) a multiplexer connected to the splitter;

e) a plurality of laser diodes connected to the multiplexer, one laser diode for each cell set and one of the laser diodes connected to at least one of the input means and the processing means; and f) N−1 electronic binary delay lines connected to at least one of the input means and the processing means each of said lines connected to a laser diode.

2. The improved phased array radar system of claim 1 wherein each electronic binary delay line is comprised of at least one GaAs switch.

3. The improved phase array radar system of claim 1 wherein each electronic binary delay line is comprised of at least two 1×2 GaAs FET switches per cell set in a back to back configuration.

4. The improved phase array radar system of claim 1 wherein each electronic binary delay line is comprised of a plurality of 1×2 GaAS FET switch pairs per cell set, each switch pair in a back to back configuration.

5. An improved phased array radar system of the type comprised of a plurality of transmit/receive cells partitioned into N cell sets, at least one of input means for inputting to the transmit/receive cells a radar signal to be transmitted and processing means for processing radar signals received from the transmit/receive cells and a plurality of bias binary fiber optic delay lines each connected between the transmit/receive cells and at least one of the input means and the processing means wherein the improvement comprises at least one electronic binary delay line connected to at least one of the input means and the processing means and each binary electronic delay line also connected to at least one of a cell set and a bias binary fiber optic delay line.

6. The improved phased array radar system of claim 5 also comprising at least one reference binary fiber optic delay line connected to a bias binary fiber optic delay line and to one of the input means and the processing means.

* * * * *